US005315775A

United States Patent [19]

Parker et al.

[11] Patent Number: 5,315,775

[45] Date of Patent: May 31, 1994

[54] DIGITAL SIGN

[75] Inventors: Thomas F. Parker, Grand Haven; Daniel J. Yenglin, Spring Lake; Bruce A. Anderson, Grand Haven, all of Mich.

[73] Assignee: Thomas F. Parker & Associates, Inc., Grand Haven, Mich.

[21] Appl. No.: 864,359

[22] Filed: Apr. 6, 1992

[51] Int. Cl.[5] ..... G09F 9/00

[52] U.S. Cl. ..... 40/450; 40/447

[58] Field of Search ..... 40/450, 447, 492; 403/162, 161, 67-69

[56] References Cited

U.S. PATENT DOCUMENTS 3,740,878 6/1973 Oelschlaeger ..... 40/447

4,024,532 5/1977 Sherwin ..... 40/450

FOREIGN PATENT DOCUMENTS 31033 7/1981 European Pat. Off. ..... 40/450

48999 4/1977 Japan ..... 40/450

2198275 6/1988 United Kingdom ..... 40/450

*Primary Examiner*—Kenneth J. Dorner

*Assistant Examiner*—Cassandra Davis

*Attorney, Agent, or Firm*—Warner, Norcross & Judd

[57] ABSTRACT

A sign for the display of characters, such as price digits, is disclosed in which each character is formed of line segments with pivoting character elements. The character elements are mounted within openings of a panel and may be pivoted to display either a contrasting surface or a noncontrasting surface.

22 Claims, 2 Drawing Sheets

DIGITAL SIGN

BACKGROUND OF THE INVENTION

1. Field of the Invention

The present invention relates to a sign, and, more particularly, to a digital sign having movable character elements.

2. Description of the Related Art

Retail stores frequently employ point-of-purchase displays which inform customers of the price of the items offered for sale. For example, a cigarette display case is often fitted with a sign showing the prices of the various types of cigarettes in the case. It is important for such pricing signs to be easily readable, yet be easily changed to display new prices.

Pricing signs of the prior art include slates or boards upon which characters are written with chalk or markers, boards which hold pre-printed cards, boards with slots which hold individual character pieces, or electronic displays using lights or LEDs which form characters. Each of these approaches has disadvantages. The readability of chalk boards and marker boards depends on the quality of the handwriting, and the chalk or markers may be misplaced. Pre-printed cards must be discarded and reprinted when the price or other printed information changes. Boards holding individual characters pieces require having a substantial inventory of character pieces and are subject to the character pieces being misplaced. Electronic displays are unduly elaborate and expensive, and may be difficult to reprogram to display new information.

Accordingly, there is a need for a sign suitable for displaying price information which is readable, economical, easily changed to display new information, and which does not employ separate parts which are easily lost.

SUMMARY OF THE INVENTION

The present invention satisfies the aforementioned need by providing a digital sign having characters made up of pivoting character elements. Each character element has a contrasting surface which may be selectably exposed or concealed to form a complete character in cooperation with the other character elements of the character. The information displayed on the sign is easily changed by pivoting the character elements. Since the character elements are permanently mounted within the sign, there are no loose parts susceptible to being lost.

According to a preferred embodiment of the invention, the sign is formed with front and rear panels with pivoting character elements captured between the panels disposed in openings formed through the front and rear panels. Each character element has a pair of surfaces, one of which is contrasting with the outer surface of the front panel and the other of which is noncontrasting. Each character of the sign is formed of seven linear elements in the manner frequently employed with LED and LCD displays. Each character element may be selectably pivoted within the panel openings to expose either the contrasting or the noncontrasting surface of the character element to form the desired characters.

According to additional features of the invention, the inner surfaces of the front and rear panels are formed with bearings which cooperate to capture pins extending from opposing lateral sides of the character elements. The front and rear panels are formed with openings which correspond to the positions of the character elements. The character elements are visible through the openings of the front panel. The openings of the front and rear panels allow the character elements to be pivoted about the axis of the pins.

The digital sign of the invention may also be mounted within a recess or receptacle of a larger sign panel or fixture. The sign may also include a sign card holder, or a front surface on which other information may be printed or written.

These and other objects, advantages, and features of the present invention will be more fully understood and appreciated by reference to the written specification and appended drawings.

DESCRIPTION OF THE PREFERRED EMBODIMENT

Figure 1:
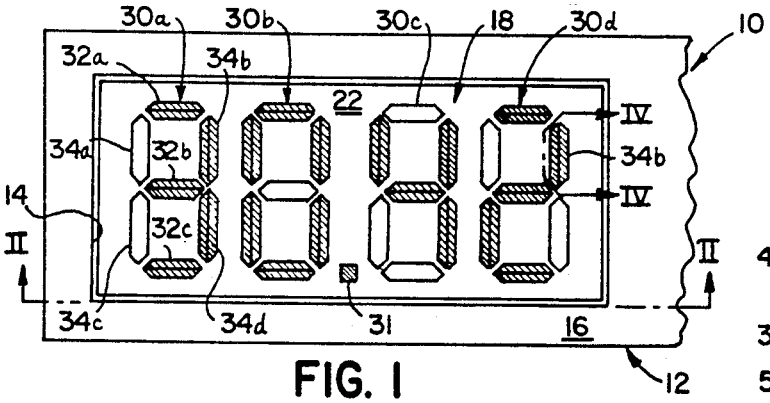
FIG. 1 is a front elevational view of a digital sign according to the principles of the invention held in the recess of a larger sign board.
Figure 2:
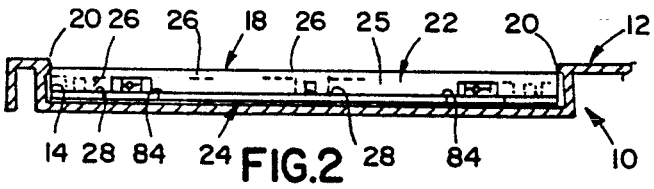
FIG. 2 is a sectional view taken along the line 2—2 of FIG. 1.

By way of disclosing a preferred embodiment, and not by way of limitation, there is shown in FIGS. 1 and 2 a sign 10 which includes in its general organization a sign board 12 having a rectangular recess 14 formed its front surface 16 and a digital sign 18 disposed in the recess 14. The digital sign 18 is in the form of an enclosed right rectangular prism, and is sized to fit within the recess 14 held in place by resilient lips 20 formed around the upper edge of the opening of the recess 14.

The sign board 12 has a larger front surface area than the digital sign 18. The front surface of the sign board 12 lying beyond the digital sign 18, such as the area to the right of the digital sign, may be used to carry other indicia such as text identifying the goods for which the price is displayed by the digital sign.

Figure 3:
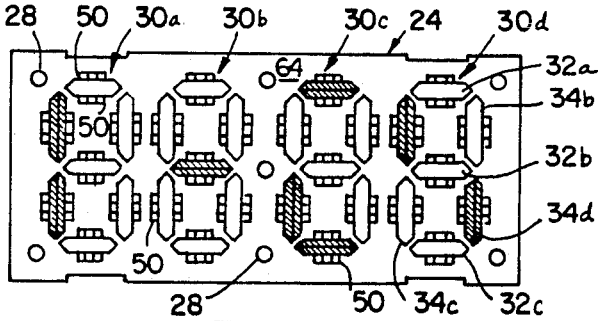
FIG. 3 is a elevational view of the inner surface of the rear panel of the digital sign with the character elements in place.

The digital sign 18 is generally in the form of a relatively thin right rectangular prism. The digital sign includes a front panel 22 having a peripheral flange 25, and a rear panel 24 generally coextensive with the rear of the front panel 22. A thin cavity 27 is disposed between the front and rear panels 22, 24 bounded by the peripheral flange 25. The front and rear panels are held in assembled relationship by a number of bosses 28 formed on the inner surface of the rear panel 24 (see also FIG. 3) which snap fit into corresponding recesses 26 formed on the inner surface of the front panel 22 (see also FIG. 7).

The digital sign 18 shown in the Figures is advantageously adapted to display price information. To that end, the digital sign includes four characters 30*a*–30*d* which display dollar and cents digits. A decimal point 31 is embossed or printed on the front panel outer surface between the characters 30*b* and 30*c*. Each of the characters 30*a*–30*d* includes seven character elements including three horizontal character elements 32*a*–32*c* and four vertical character elements 34*a*–34*d*. The character elements are arranged in a well-known manner by which alphanumeric characters may be formed by causing certain of the character elements to assume an appearance contrasting with the background.

Figure 4:
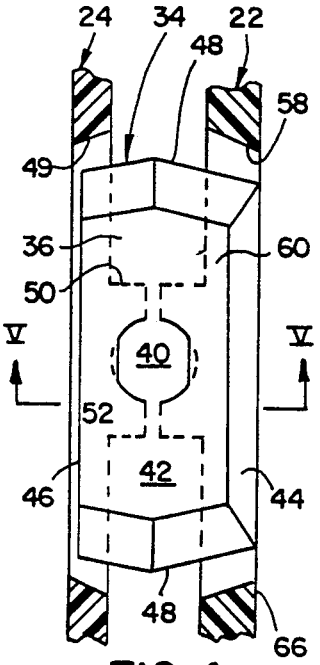
FIG. 4 is a sectional view of a single character element disposed between the front and rear panels of the digital sign taken substantially along the line 4—4 of FIG. 1.
Figure 5:
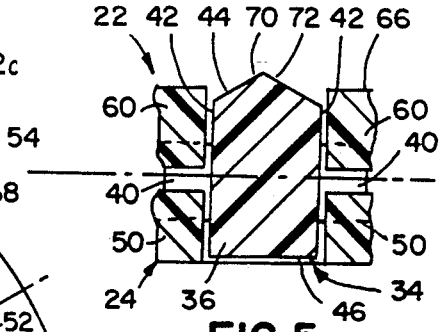
FIG. 5 is a sectional view taken along the line 5—5 of FIG. 4.
Figure 6:
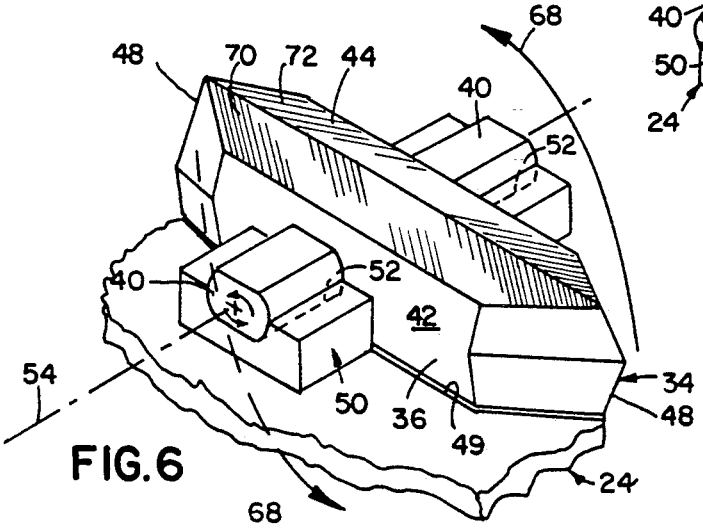
FIG. 6 is a perspective, fragmentary view of a single character element supported on the bearing halves of the inner surface of the rear panel.

Further details of the character elements may be seen in FIGS. 4–6. A single character element 34 is shown which is representative of each of the character elements 32*a*–32*c* and 34*a*–34*d* of each of the characters 30*a*–30*d*. The horizontal character elements 32*a*–32*c* are slightly shorter than the vertical elements 34*a*–34*d* for a more pleasing appearance of the characters.

The character element 34 is preferably formed of molded plastic material having a longitudinally elongated body 36. A pair of short pins 40 extends laterally outwardly from each of the two opposed lateral sides 42 of the body. The character element further includes first and second longitudinally extending character forming surfaces 44, 46. The character forming surfaces are disposed generally parallel to and opposite each other extending laterally between the sides 42 and the ends 48. First character forming surface 44 is provided with an appearance contrasting with the front surface of the front panel 22. Preferably, the surface 44 is painted a dark color which contrasts with the light color of the front panel 22. Second character forming surface 46 is provided with an appearance matching the front surface of the front panel 22. Preferably, the front panel and the character elements 34 are molded of plastic of matching colors.

The rear panel 24 is formed with twenty-eight openings 49. Each opening defines and corresponds to the position of one of the character elements 34 and is provided to give clearance to the ends of a character element as the character element is pivoted as described more fully below. As best shown in FIG. 6, the inner surface of the rear panel is formed with a number of bearing halves 50. The bearing halves 50 are disposed in pairs, each bearing half of each pair disposed at the opposed sides of the openings 49.

Each bearing half 50 is formed with a generally semicylindrical recess 52. Each recess is shaped to cradle a pin 40 of the character element 34 disposed in the associated opening 49 of the rear panel 24. The recesses 52 of the pairs of bearing halves have a common axis. In this manner, each character element 34 is able to pivot about its transverse axis 54.

Figure 7:
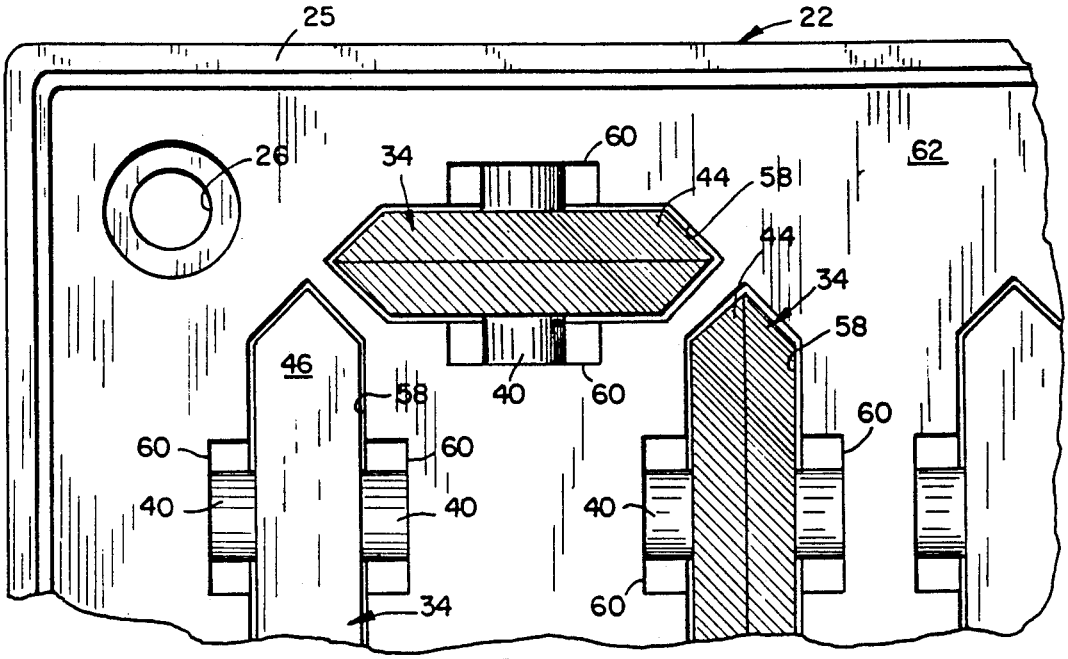
FIG. 7 is an enlarged, fragmentary, elevational view of the inner surface of the front panel of the digital sign with character elements in place.

Referring now to FIGS. 4, 5 and 7, it may be seen that the front panel 22 is formed similarly to the rear panel 24 with its inner surface having a number of openings 58 in correspondence with the character elements 34, and pairs of bearing halves 60 disposed at the center of opposite sides of the openings 58. The pins 40 of the character elements 34 are pivotably cradled in the bearing halves 60 in the same manner as shown in FIG. 6. The inner surface 62 of the front panel 22 is thus formed similarly to the inner surface 64 (FIG. 3) of the rear panel 24.

When the front and rear panels 22, 24 are assembled together, as shown in FIGS. 4 and 5, the pins 40 of each character element 30 are pivotably captured and journalled between the opposed, mating bearing halves 50, 60 of the panels. Each character element 34 may be individually and selectably flipped end-over-end, as indicated by arrows 68. Thus, any desired price or other information may be displayed, such as "30.42" as in FIG. 1.

As shown in FIGS. 4 and 5, axis 54 of the pins 40 of each character element 34 is disposed slightly closer to the noncontrasting surface 46 of the character element than to the contrasting surface 44. With this arrangement, the forwardly exposed contrasting surface 44 of a character element protrudes slightly beyond the plane of the outer surface 66 of the front panel 22 to provide greater legibility. When the character element is flipped over, the noncontrasting surface 46 is disposed substantially coplanar with the outer surface 66, or slightly recessed therefrom, to make the noncontrasting surface less visible.

Advantageously, the ends 48 of the character elements 34 are tapered and beveled to provide clearance with the ends of the openings 49, 58 when the character elements are pivoted and to allow the ends of adjacent character elements to be spaced more closely together. Furthermore, the contrastinq surface 44 of the character elements may be beveled with two facets 70, 72 to improve legibility, while the noncontrasting surface 46 is flat.

Since the digital sign is self-contained with the character elements permanently captured between the front and rear panels, the character elements will not be lost. There is no need to store an assortment of individual characters. When it is desired to change the information displayed on the digital sign, the digital sign is merely removed from the sign board 12, the character elements are pivoted to form the desired characters, and the digital sign is replaced in the sign board.

Figure 8:
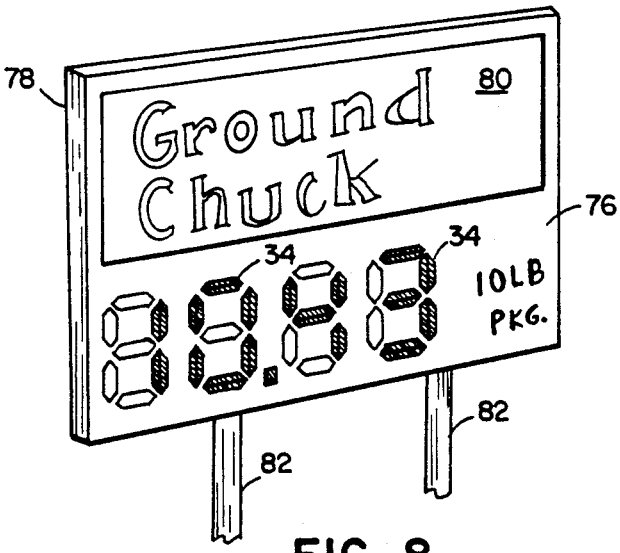
FIG. 8 is a perspective view of an alternate embodiment of the digital sign according to the invention including an additional exhibiting surface.

An alternate embodiment of the digital sign according to the principles of the invention is shown in FIG. 8. The character elements 34 are pivotably captured between larger front and rear panels 76, 78. The front panel has a field area 80 on which indicia may be carried or in which an interchangeable card may be inserted. There are also legs 82 affixed to the sign for use in supporting the sign on a rack, refrigerator, or the like.

As shown in FIG. 2, the periphery of the digital sign may be formed with recesses 84. Such recesses may be used as detents to hold the digital sign in the recess of a sign board.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A digital sign for displaying characters comprising:

a panel means having an outer, viewable surface with a plurality of openings formed therethrough, said opening disposed in an array from which characters may be formed, said panel means including a front panel and a rear panel disposed in overlying, spaced apart relationship defining a cavity therebetween;

a plurality of character elements, each of said character elements comprising an elongated body having longitudinally spaced apart ends and transversely opposed sides extending between said ends, each of said character, elements disposed in correspondence with one of said openings and having a first surface having an appearance contrasting with an appearance said outer, viewable surface, and a second surface having an appearance noncontrasting with the appearance of said outer, viewable surface;

a plurality of pivot means for pivotably journalling said character elements within said cavity, each of said pivot means disposed at a central extent of said opposed sides of a said character element and defining a transverse pivot axis, each of said pivot means pivotably carrying one of said character elements such that each of said character elements may be individually and selectably pivoted end-over-end about said transverse pivot axis to form a character in cooperation with other character elements, said pivot means including coaxial pins extending laterally outwardly from said opposed sides of each character element between said first and second surfaces, said front panel and said rear panel formed with bearing halves disposed within said cavity, said bearing halves mating to form bearings in which said pins are journalled.

2. A digital signal for displaying characters comprising:

a front panel having a front viewable surface and a plurality of openings formed therethrough disposed in correspondence with line segments of characters to be formed and displayed;

a rear panel disposed coextensively behind said front panel forming a cavity therebetween, said front and rear panels formed with a plurality of bearing halves disposed within said cavity in pairs on opposed sides of said openings and matably cooperating to form bearings;

a plurality of character elements, each character element carried substantially within said cavity in correspondence with on of said openings and comprising an elongated body having longitudinally spaced apart ends, a first surface having an appearance contrasting with an appearance of said front viewable surface a second surface having an appearance noncontrasting with the appearance said front viewable surface, and pivot pin means disposed between said ends and transversely of said elongated body and journalled within said bearings within said cavity;

whereby each of said character elements may be selectably and individually pivoted end-over-end to form characters in cooperation with other character elements.

3. The digital sign of claim 2 wherein said pivot pin means protrude laterally from opposed sides of said character elements.

4. The digital sign of claim 3 wherein said pivot pin means having a common axis disposed closer to said first surface than said second surface, whereby said first surface protrudes beyond said front viewable surface when exposed to view.

5. The digital sign of claim 4 wherein said second surface is substantially coplanar with said front viewable surface when exposed to view.

6. The digital sign of claim 2 further comprising a sign board, said sign board formed with a recess and said front panel and said rear panel carried within said recess.

7. A digital signal for displaying characters comprising:

a front panel having a front viewable surface and a plurality of openings formed therethrough disposed in correspondence with line segments of characters to be formed and displayed;

a rear panel disposed coextensively behind said front panel forming a cavity therebetween, said rear panel is formed with a plurality of openings formed therethrough disposed in correspondence with the openings of said front panel; and a plurality of character elements, each character element carried substantially within said cavity in correspondence with one of said openings and comprising an elongated body having longitudinally spaced apart ends, a first surface having an appearance contrasting with an appearance of said front viewable surface a second surface having an appearance noncontrasting with the appearance of said front viewable surface, and pivot pin means disposed between said ends and transversely of said elongated body and journalled within said cavity;

whereby each of said character elements may be selectably and individually pivoted end-over-end to form characters in cooperation with other character elements.

8. A signal for displaying a plurality of characters, each of said characters formed of a plurality of line segments, each of said line segments comprising an elongated character element pivotably carried on a panel assembly including a front panel having a front viewable surface and a rear panel, said front panel having a plurality of openings formed therethrough, each character element having longitudinally spaced apart ends and a transverse pivot axis disposed between said ends, a first surface of an appearance contrasting with an appearance of said front viewable surface and a second surface of an appearance noncontrasting with the appearance of said front viewable surface, each of said character elements disposed in correspondence with one of said openings and viewable therethrough, said character elements journalled to said front and rear panels to pivot within said openings, whereby said character elements are selectably and individually pivoted end-over-end about said transverse pivot axis to form said characters.

9. A sign for displaying a plurality of characters, each of said characters formed of a plurality of line segments, each of said line segments comprising a character element pivotably carried on a panel assembly having a front viewable surface, each character element having a first surface of an appearance contrasting with an appearance of said front viewable surface and a second surface of an appearance noncontrasting with the appearance of said front viewable surface, wherein said panel comprises a front panel and a rear panel, said front panel having a plurality of openings formed therethrough, each of said character elements disposed in correspondence with one of said openings and viewable therethrough, said character elements journalled to said front and rear panels to pivot within said openings, whereby said character elements are selectably and individually pivoted to expose either said first surface or said second surface to form said characters.

10. The signal of claim 9 wherein said character elements are journalled to pivot end-over-end.

11. The sign of claim 9 wherein said front panel and said rear panel each include inner surfaces formed with identical, mating bearing halves disposed adjacent said openings, said bearing halves cooperating to form bearings, said character elements each having longitudinally spaced apart ends and opposed lateral sides, said opposed lateral sides each having a central extent disposed between said ends, said character elements each further having pin means protruding transversely from said central extent of said opposed lateral sides of said character elements disposed between said first and second surfaces, said pin means being captured and journalled between said bearing halves.

12. The signal of claim 11 wherein said front panel and said rear panel including means for snap fitting the panels.

13. The sign of claim 11 further comprising a plurality of openings formed through said rear panel disposed in correspondence with said character elements and with said openings formed through said front panel.

14. The sign of claim 13 wherein said first surface of said character elements when exposed to view protrude beyond said viewable surface of said front panel.

15. The sign of claim 14 wherein said second surface of said character elements when exposed to view lie substantially flush with said viewable surface of said front panel.

16. A digital sign for displaying characters comprising:

a front panel and a rear panel disposed in overlying, spaced apart relationship defining a cavity therebetween, said front panel having an outer, viewable surface with a plurality of openings formed therethrough, said openings disposed in an array from which characters may be formed, said front panel and said rear panel formed with bearing halves disposed within said cavity, said bearing halves mating to form bearings;

a plurality of character elements, each said character element having a first surface having an appearance contrasting with an appearance said outer, viewable surface, and a second surface having an appearance noncontrasting with the appearance of said outer, viewable surface, each said character element further having coaxial pins extending laterally outwardly from opposed sides of said character element between said first and second surfaces, said pins being pivotably journalled within said cavity in said bearings;

whereby each of said character elements may be individually and selectably pivoted to expose to view through one of said openings either said first surface of said second surface to form a character in cooperation with other character elements.

17. A digital sign for displaying characters comprising:

a front panel having a front viewable surface and a plurality of openings formed therethrough disposed in correspondence with line segments of characters to be formed and displayed;

a rear panel disposed coextensively behind said front panel forming a cavity therebetween;

said front and rear panels formed with a plurality of bearing halves disposed within said cavity in pairs on opposed sides of said openings and matably cooperating to form bearings;

a plurality of character elements, each character element carried substantially within said cavity in correspondence with one of said openings and comprising an elongated body having a first surface having an appearance contrasting with said front viewable surface, a second surface having an appearance noncontrasting with the appearance said front viewable surface, and pivot pin means disposed transversely of said elongated body and journalled in said bearings;

whereby each of said character elements may be selectably and individually pivoted to expose a view through said openings either said first surface or said second surface thereby to form characters in cooperation with other character elements.

18. The digital sign of claim 17 wherein said pivot pin means protrude along a common axis and laterally from opposed sides of said character elements, whereby said character elements may be pivotably flipped end-over-end.

19. The digital sign of claim 8 wherein said common axis of said pivot pin means is disposed closer to said first surface than said second surface, whereby said first surface protrudes beyond said front viewable surface when exposed to view.

20. The digital sign of claim 19 wherein said second surface is substantially coplanar with said front viewable surface when exposed to view.

21. The digital sign of claim 17 further comprising a sign board, said sign board formed with a recess and said front panel and said rear panel carried within said recess.

22. The digital sign of claim 17 wherein said panel is formed with a plurality of openings formed therethrough disposed in correspondence with the openings of said front panel.

* * * * *

UNITED STATES PATENT AND TRADEMARK OFFICE

CERTIFICATE OF CORRECTION

PATENT NO. : 5,315,775

DATED : May 31, 1994

INVENTOR(S) : Thomas F. Parker et al

It is certified that error appears in the above-indentified patent and that said Letters Patent is hereby corrected as shown below:

Column 4, Claim 1, Line 66:
"opening" should be --openings--.

Column 5, Claim 1, Line 7:
after "character" delete --,--.

Column 5, Claim 2, Line 46:
"on" should be --one--.

Column 5, Claim 2, Line 51:
after "appearance" insert --of--.

Column 6, Claim 7, Line 8:
"signal" should be --sign--.

Column 6, Claim 7, Line 25:
after "viewable surface" insert --,--.

Column 6, Claim 8, Line 44:
after "surface" insert --,--.

Column 6, Claim 8, Line 1:
"signal" should be --sign--.

Col. 7, claim 12, line 1:
"signal" should be --sign--.

Column 8, Claim 17, Line 22:
after "with" insert --an appearance of--.

UNITED STATES PATENT AND TRADEMARK OFFICE

CERTIFICATE OF CORRECTION

PATENT NO. : 5,315,775

DATED : May 31, 1994

INVENTOR(S) : Thomas F. Parker et al

It is certified that error appears in the above-indentified patent and that said Letters Patent is hereby corrected as shown below:

Column 8, Claim 17, Line 25:
insert "of" before --said--.

Column 8, Claim 17, Line 29:
"a" should be --to--.

Column 8, Claim 22, Line 50:
after "said" insert --rear--.

Signed and Sealed this

Eighteenth Day of October, 1994

Bruce Lehman

*Attest:*

BRUCE LEHMAN

*Attesting Officer*

*Commissioner of Patents and Trademarks*